US005772474A

United States Patent [19]

Yagi et al.

[11] Patent Number: 5,772,474

[45] Date of Patent: Jun. 30, 1998

[54] ELECTRICAL CONNECTOR WITH EMBEDDED TERMINALS

[75] Inventors: Masanori Yagi, Ebina; Kazunobu Saito, Machida, both of Japan

[73] Assignee: Molex Incorporated, Lisle, Ill.

[21] Appl. No.: 642,240

[22] Filed: May 2, 1996

[30] Foreign Application Priority Data

Sep. 7, 1995 [JP] Japan ..... 7-010434 U

[51] Int. Cl.[6] ..... H01R 17/00

[52] U.S. Cl. ..... 439/660; 439/736

[58] Field of Search ..... 439/74, 444, 736, 439/660; 29/842, 848

[56] References Cited

U.S. PATENT DOCUMENTS

| | | | |
|---|---|---|---|
| 3,261,909 | 7/1966 | Rust et al. | 439/444 X |
| 3,761,869 | 9/1973 | Hardesty et al. | 439/444 X |
| 4,113,179 | 9/1978 | McKee . | |
| 4,734,060 | 3/1988 | Kawarada et al. | 439/660 |
| 5,074,039 | 12/1991 | Hillbish et al. | 29/883 |
| 5,161,985 | 11/1992 | Ramsey | 439/74 |
| 5,167,528 | 12/1992 | Nishiyama et al. | 439/489 |
| 5,176,541 | 1/1993 | Mori | 439/736 |
| 5,181,855 | 1/1993 | Mosquera et al. | 439/74 |
| 5,192,232 | 3/1993 | Lenz et al. | 439/660 |
| 5,201,883 | 4/1993 | Atoh et al. | 29/883 |
| 5,203,710 | 4/1993 | Miyazawa | 439/71 |
| 5,224,866 | 7/1993 | Nakamura et al. | 439/81 |
| 5,310,357 | 5/1994 | Olson | 439/346 |

FOREIGN PATENT DOCUMENTS

| | | | |
|---|---|---|---|
| 0 567 007 A3 | 10/1993 | European Pat. Off. . | |
| 3-64487 | 6/1991 | Japan | H01R 23/68 |

*Primary Examiner*—Khiem Nguyen
*Attorney, Agent, or Firm*—Charles S. Cohen; James C. Paschall

[57] ABSTRACT

An electrical connector has a longitudinal slot and a plurality of terminals fixed within the slot in the connector housing. The terminals are arranged at regular intervals and embedded in the sidewalls of the housing during the process of insert-molding the connector. Each terminal includes a contact portion which is positioned vertically in the connector housing slot along the inner walls thereof, an engagement end which is embedded in the housing sidewalls, and a solder tail portion which extends out of the connector. The contact portion is retained in place on the inner walls of the connector slot by virtue of the engagement end being embedded in the housing sidewall.

29 Claims, 7 Drawing Sheets

ELECTRICAL CONNECTOR WITH EMBEDDED TERMINALS

BACKGROUND OF THE INVENTION

The present invention generally relates to electrical connectors and more particularly, to an electrical connector having a plurality of conductive terminals fixed within its molded housing in a manner to decrease the possibility of deformation of the terminals under connection forces.

Electrical connectors are well known in the art and are used in a variety of applications. Such connectors are commonly used to provide a connection between two opposing circuit boards. This type of connectors is referred to in the art as board to board connectors and typically include opposing interengaging male and female connector components, each of which has a housing with a plurality of conductive terminals arranged therein. The female connector component may typically include a slot which receives the male connector component in a connective relationship. A plurality of conductive terminals are arranged within this slot in a longitudinal spacing, known as the "pitch" of the connector.

Inasmuch as electronic devices are constantly being reduced in size, smaller connectors are desirable. In order to achieve this desired size reduction, the pitch of connectors is being reduced to distances of between 0.635 mm to 0.5 mm. These small pitch connectors are often made by an insert molding process wherein the terminals are inserted into a mold, held in a predetermined order within the mold and a housing is molded around the terminals from an insulative material such as plastic in order to form the connector.

One such insert-molded connector is shown in Japanese Laid-open Utility Model Application No. 3-64486. The housing of this connector has a longitudinal slot which extends down to its bottom in order to accommodate an associated plug connector. All of the terminals of the connector are arranged with their contact surfaces exposed along the internal walls surrounding the longitudinal slot of the housing mold. These terminals cannot be fixed reliably in the connector slot and are therefore may be deformed, or peeled away, from the internal wall surfaces of the housing slot when a force is applied obliquely to the contact stem of the terminal, such as that which can occur when the plug connector is slightly misaligned during insertion into the female connector.

The present invention is directed to an electrical connector in which a portion of each terminal is securely embedded in the connector housing which avoids the disadvantages of the prior art as set forth above.

SUMMARY OF THE INVENTION

Accordingly, it is a general object of the present invention to provide an insert-molded type of electric connector having its terminals firmly anchored to its molded housing wherein the terminals are free of any deformation or peeling-off which otherwise would be caused if the terminal is subjected to an application of force in an oblique direction relative to the terminal contact portions.

Another object of the present invention is to provide an improved connector in which the terminals include means for engaging the sidewalls of the connector slot, the engagement means including one or more engagement tabs which are insert molded into the connector housing. The engagement tabs retaining the terminals and their associated contact portion in place within the housing slot to thereby reduce the likelihood of deformation of the terminals occurring during mating with another connector.

To attain these objects, the present invention provides in a first embodiment, an electrical connector having a plurality of conductive terminals fixed in a housing molded thereover. The terminals are arranged at regular intervals and partially embedded within the insulative plastic used in molding the connector. The connector housing has a longitudinal slot which opens on its upper surface and extends down to the bottom of the connector in order to accommodate an associated plug connector. Each terminal includes a contact portion, or stem, lying on the inside walls of the housing slot. The terminals also include engagement ends integrally connected to the contact portions which are embedded in the walls of the housing, thereby anchoring each terminal to the insert-molded connector housing.

In another embodiment, the present invention provides an electrical connector having a longitudinal connector slot and a plurality of conductive terminals arranged therein in two parallel rows at a predetermined pitch. The terminals include elongated body portions and solder tail portions disposed at opposite ends of the terminal body portions and extending generally transverse to the body portions. A housing is molded around the terminal engagement end portions in such a manner that individual retention ribs or members are formed between adjacent terminal engagement ends. The engagement ends of the terminals include extending projections which engage the retention ribs of the housing in manner which anchors the terminal contact portions in place within the connector slot against the inner surfaces of the connector housing slot.

This structure of the present invention offers an advantage over the prior art in that it substantially prevents the terminal contact portions from separating, or peeling away, from the inside wall of the housing connector under the influence of oblique force applied to the connector terminals during connection.

In order to form the anchoring feature at the terminal engagement ends, the contact portions include bent end portions which extend parallel to the top surface of the connector housing. One of the bent ends defines a solder tail portion, while the other bent end is laid and embedded within the sidewalls of the housing either beneath the level of the upper surface of the connector or generally flush therewith.

These and other objects, features and advantages of the present invention will be clearly understood through a consideration of the following detailed description.

BRIEF DESCRIPTION OF THE DRAWINGS

In the course of the following description of the detailed description, reference will be made to the attached drawings wherein like reference numerals identify like parts and wherein.

DETAILED DESCRIPTION OF PREFERRED EMBODIMENTS

Figure 3:
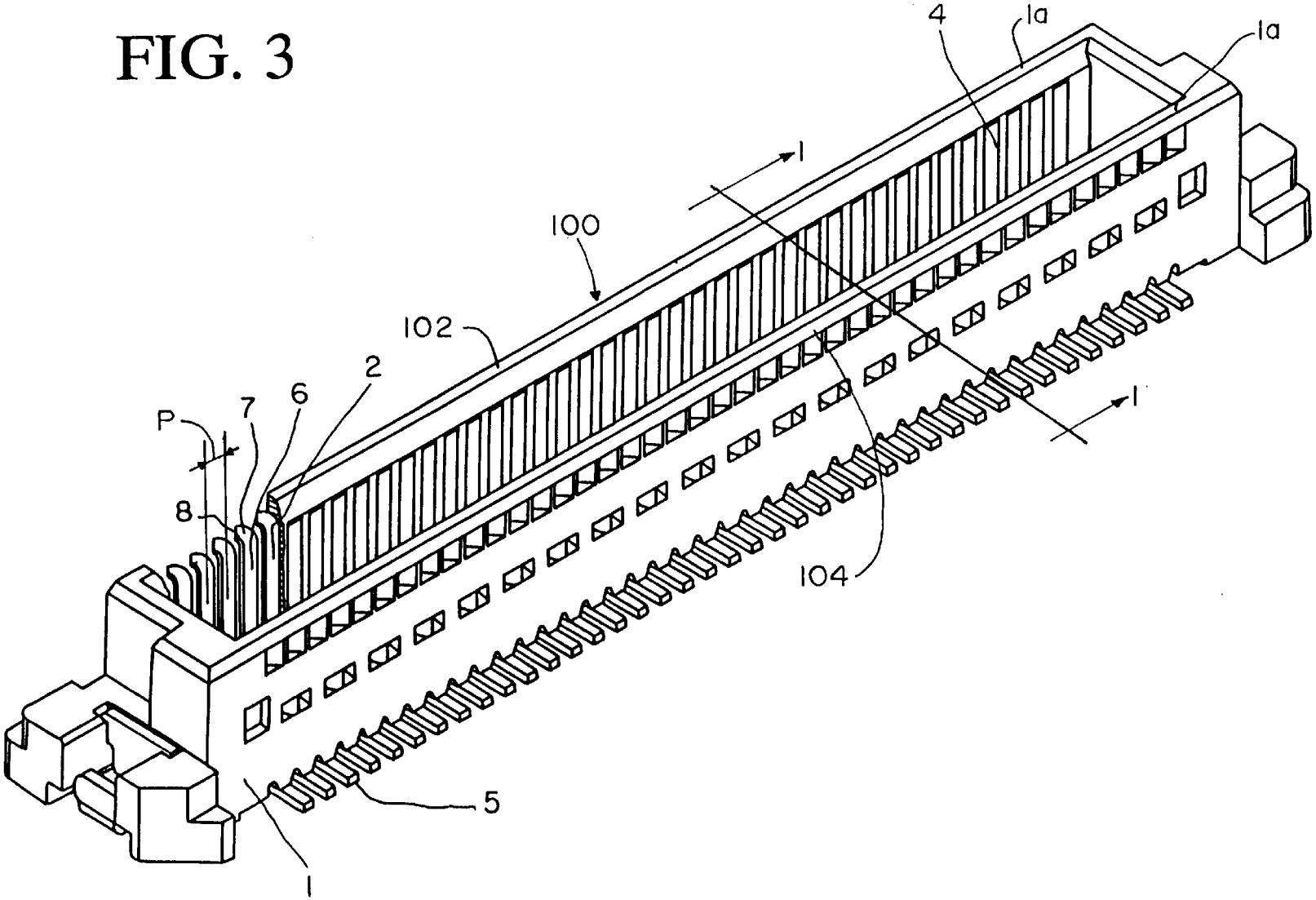
FIG. 3 is a perspective view of the connector of FIG. 1, with a portion of the connector housing removed for clarity.

Referring first to FIG. 3, one embodiment of an electrical connector constructed in accordance with the principles of the present invention is illustrated generally at 100. The connector 100 is seen to include an elongated housing 1 and a longitudinal connector slot 4 extending for a predetermined length between two sidewalls 102, 104 of the housing 1. This slot 4 opens upwardly at 3 and extends down to its bottom or floor 1*b* of the connector housing 1 to define the depth of the slot 4. As is known in the art, this slot 4 accommodates an associated multi-contact plug connector (not shown) which interengages with the housing 1 and terminals 2 therein to form a connection between two printed circuit boards.

It will be understood that the female connector housing 2 illustrated is merely exemplary of the connector environment in which the terminals of the present invention may be used. Other connector structures may utilize the present invention with equal results and benefits.

The plug connector which is received within the slot 4 of the female connector housing 1 has a series of terminals arranged on its plug in a predetermined spacing or pitch. This pitch is indicated at P in FIG. 3 and represents the spacing between the centerlines of adjacent terminals. The same pitch is maintained on the two connector components in order to ensure reliable electrical contact occurring at the contact portions of the terminals. The female connector 100 and plug connector are often joined together forcefully. It has been noted that when one or both of the male and female connector components are slightly misaligned either longitudinally or laterally with respect to each other or the circuit board, oblique forces are exerted on the terminal contact portions. These forces may cause the contact portions of the terminals to separate or peel away from the inner surfaces of the connector housing slot 4. The present invention is directed to a connector structure which overcomes this problem.

Figure 2:
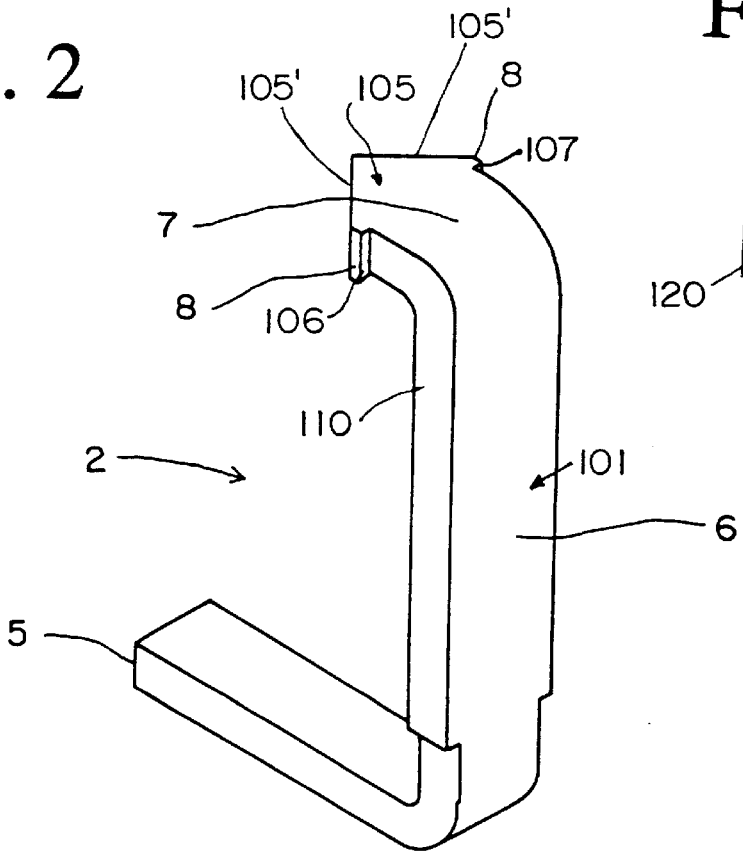
FIG. 2 is a perspective view of a conductive terminal used in the connector of FIG. 1.

The connector 100 further includes a plurality of electrically conductive terminals 2 fixed in the housing 1 along the slot 4. As illustrated in FIG. 2, each terminal 2 of the connector 100 can be seen to include a terminal body 101 with a contact portion 6 thereon, a engagement end portion 7 integrally connected to the terminal body 101 and a solder tail portion 5 integrally connected to the bottom of the terminal body 101. The engagement end and solder tail portions 7, 5 are formed by bending the opposite ends of the terminal body 101 in the same direction to define a general U-shape to the terminal 2.

Figure 1:
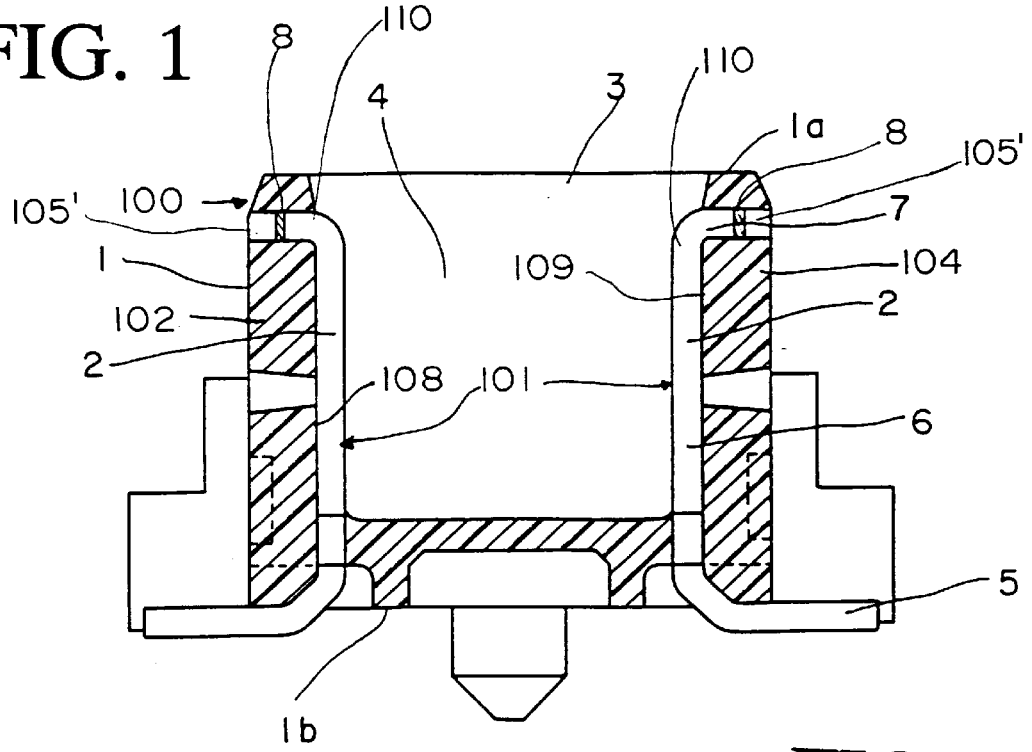
FIG. 1 is a sectional view of one embodiment of an electric connector constructed in accordance with the principles of the present invention taken generally along line 1—1 of FIG. 3.

Returning to FIG. 1, the terminals 2 are secured within the connector 100 during the course of insert-molding the connector housing 1 around the terminals 2. In this process, the terminals 2 are arranged within a mold (not shown) and held in place in their desired end order. Specifically, the terminals 2 are arranged at regular intervals (for instance, at small pitches on the order of from 0.635 mm to 0.5 mm) in two parallel rows along the housing sidewalls 102, 104 which define the slot 4. The contact portions 6 of the terminal bodies 101 of the terminals 2 are aligned in these two rows with their engagement ends 7 and solder tail portion 5 extending outwardly in the opposite directions. The terminals 2 are positioned in the mold at a predetermined height so that their engagement end portions 5 are buried in the insulative plastic injected into the mold.

As shown in FIG. 2, each engagement end portion 7 has a pointed or arrowhead-like endtip 105 having two projecting catches, or projections 8, on opposite diverging edges 105' of the engagement end portions 7. These projections serve to provide surfaces 106, 107 to anchor the terminals 2 to the sidewalls 102, 104 of the connector 100. Each terminal 2 has its contact portion 6 adjacent the respective opposing, interior surfaces 108, 109 of the connector sidewalls 102, 104 of the slot 4 of the housing 1. The terminals 2 are arranged in a predetermined, desired order and pitch.

During the molding process, the tips of engagement end portions 7 are forced into like-shaped recesses in a mold cavity and retained there by applying a force to contact portions 6. Upon inserting plastic into the mold cavity around terminals 2, plastic is positioned along the side edges 110 of the terminals. The edges 106, 107 of projections 8 engage the plastic to securely retain the terminals within the sidewalls 102, 104 of the molded housing below the upper surface la thereof. Such molding process is more specifically described in European Patent Publication No. EP 693802, published Jan. 24, 1996, assigned to the assignee of the present invention and incorporated herein by reference.

The configuration of the engagement end portions 7 effectively anchors the terminals in place within the connector slot 4. This anchoring improves the reliability of the connector, especially in small pitch connectors wherein the pitch is on the order of from 0.635 mm to 0.5 mm, because it substantially prevents the contact portions 6 of the terminals 2 from deforming or separating away from the sidewalls 102, 104 of the connector slot into or towards the center of the slot in instances where the opposing plug connector is inserted into the longitudinal slot obliquely, thereby applying an oblique force to the contact portions 6 of the terminals 2.

FIGS. 4 to 12, illustrate a second embodiment of an electrical connector 200 constructed in accordance with the principles of the present invention similar in structure to the connector 100 of the first embodiment. In this second embodiment, certain like structural elements are identified with a reference numeral having a prime, i.e., 1'.

Figure 4:
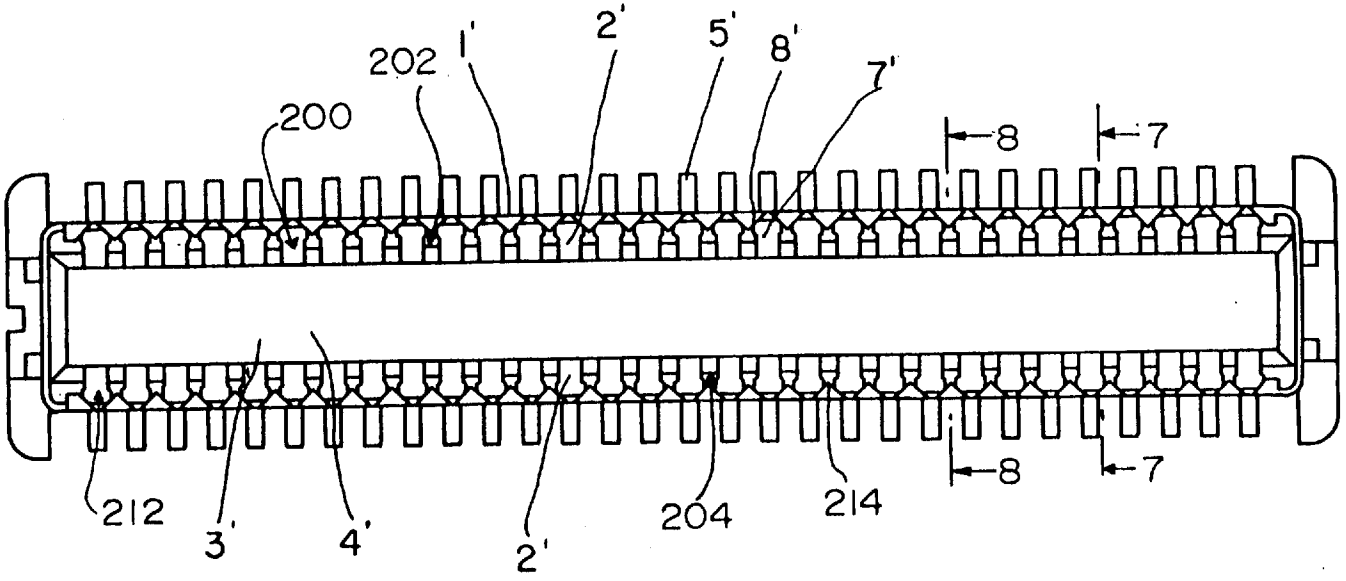
FIG. 4 is a plan view of a second embodiment connector constructed in accordance with the principles of the present invention.
Figure 5:
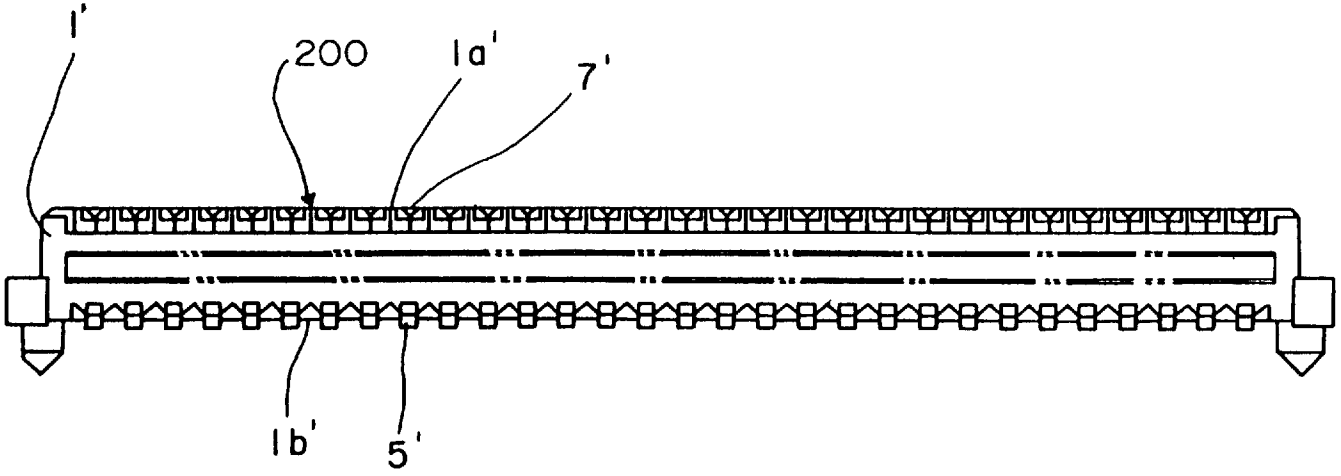
FIG. 5 is an elevational view of the connector of FIG. 4.
Figure 6:
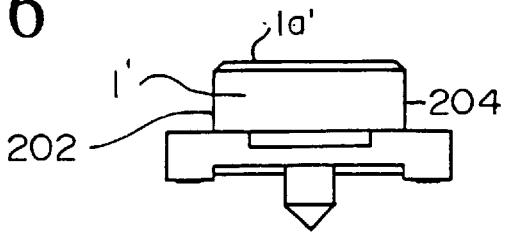
FIG. 6 is an end view of the connector of FIG. 6.

As illustrated in FIGS. 4 & 5, the connector 200 includes an elongated housing 1' having a longitudinal plug connector slot 4' disposed therein between two opposing sidewalls 202, 204. The connector 200 has a plurality of conductive terminals 2' arranged within the slot 4' in two parallel, opposing rows extending for the length of the slot 4'. As illustrated in FIGS. 7 and 10–12, each terminal 2' is formed from a metal strip 220 and has a body portion 208, an engagement end portion 7' and a solder tail portion 5'. The terminal body portion 208 also includes a contact portion 6' which extends therealong between the respective engagement end 7' and solder tail portions 5'.

Figure 7:
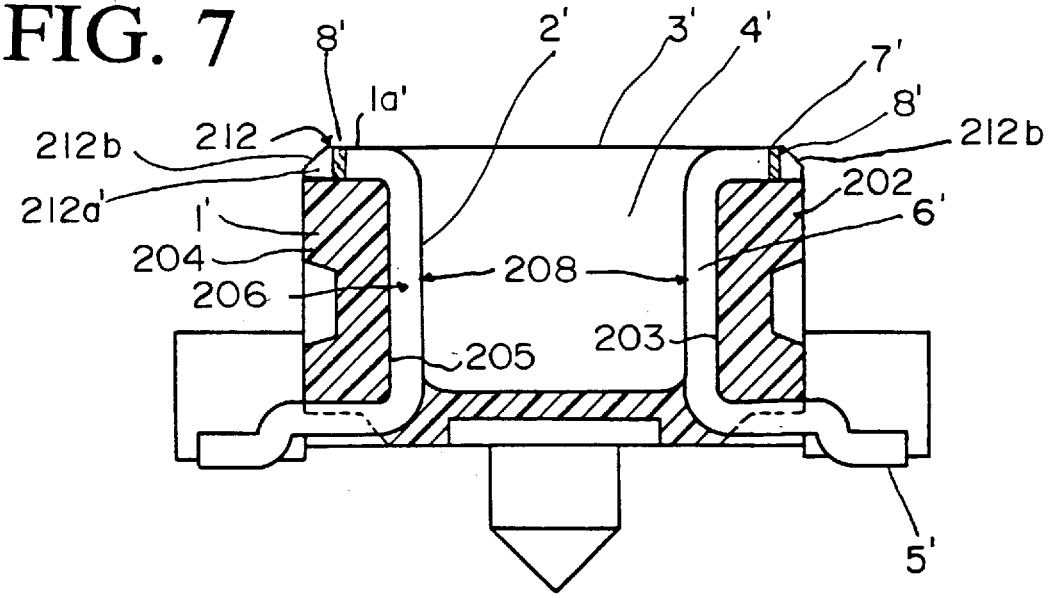
FIG. 7 is a sectional view of the connector of FIG. 4 taken generally along line 7—7 thereof.
Figure 8:
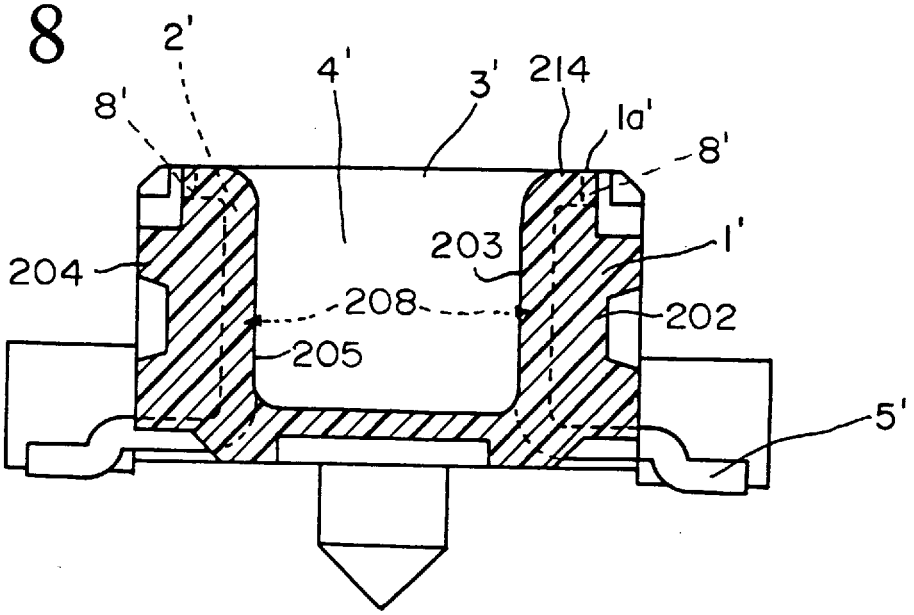
FIG. 8 is a sectional view of the connector of FIG. 4 taken generally along line 8—8 thereof.
Figure 9:
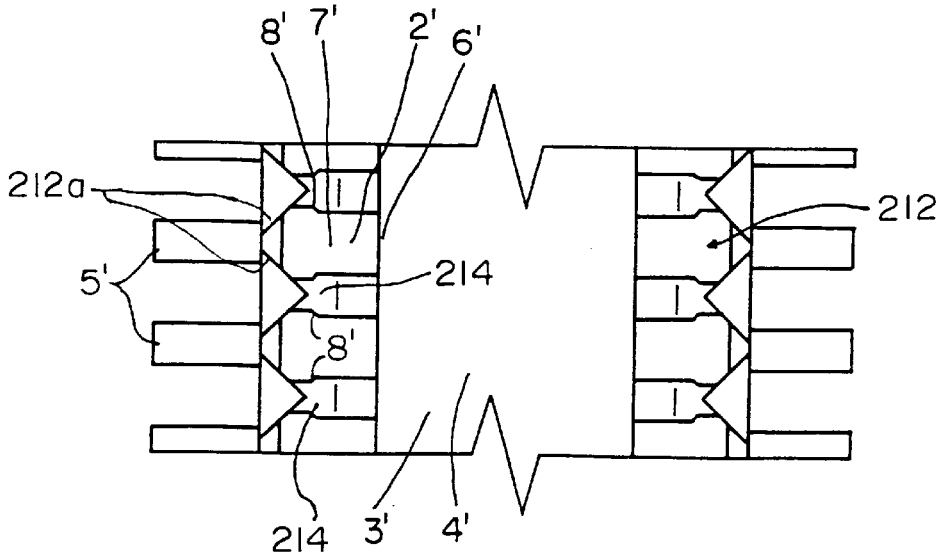
FIG. 9 is an enlarged plan view of a portion of the connector of FIG. 4.
Figure 10:
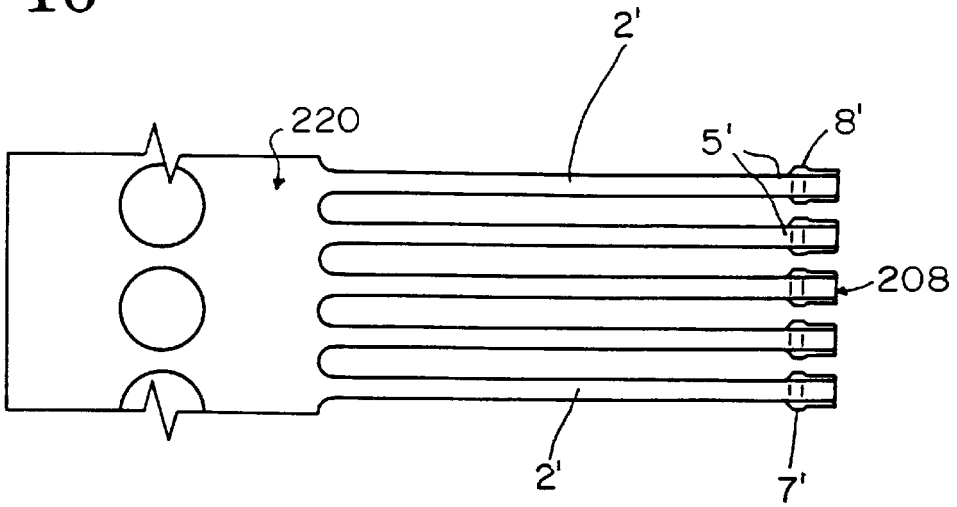
FIG. 10 is a plan view of a carrier strip of terminals used in the connector of FIG. 4.

The solder tail 5' and engagement end portions 7' are bent outwardly from the terminal body portions 208 and extend generally transversely to the axis of the body portion 208 which is also coterminous to the axis of the contact portion 6'. The terminals 2' (as well as the terminals 2) present a general U-shape configuration when viewed from the side. (FIG. 7.)

The endtips 212 have angled leading edges 212*a* as described above with respect to the first embodiment. However, the tip is also tapered downward at 212*b* to provide a lead-in surface for mating with a complementary connector. The endtips further have a pair of catches or projections 8' extending outwardly on their opposite sides. These projections 8' are positioned in the connector housing mold (not shown) as described with respect to the first embodiment and so that they are located at slightly below or at the level of the upper surface level 1*a'* of the housing 1' and are embedded within the housing sidewalls 202, 204. As such, plastic intervening retention posts 214 molded integrally with the sidewalls 202, 204 extend between the terminal endtips 212. Such retention posts 214 engage projections 8' to thereby anchor the contact portions 6' of the terminals 2' in place within the connector housing slot 4' and against the inner surfaces 203, 205 of the sidewalls 202, 204.

The endtips 212 may be considered as embedded in recesses formed along the upper surfaces 1*a'* of the connector housing sidewalls 202, 204. This anchoring substantially prevents the contact portions 6' from being deformed or peeled-away from the inner surfaces 203, 205 due to any oblique force, such as that caused by inserting the plug connector obliquely into the slot 4 of the housing 1'.

Figure 11:
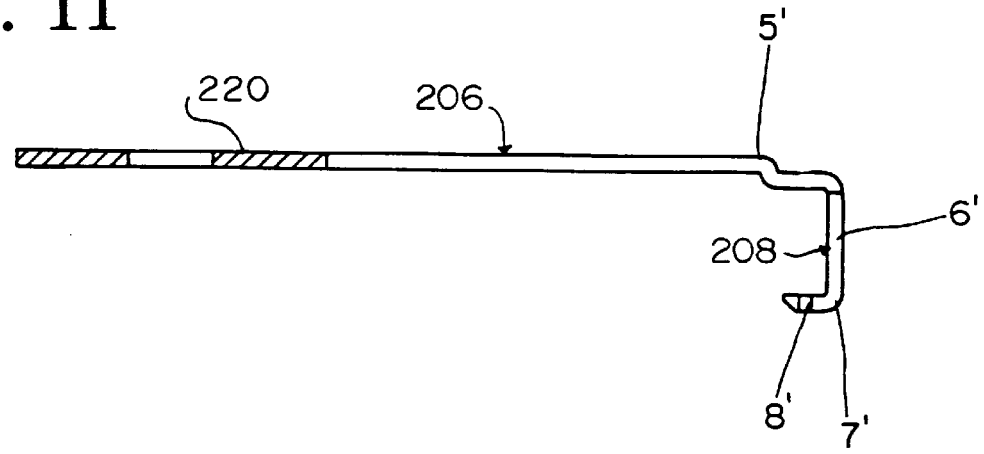
FIG. 11 is a side view of terminal carrier strip of FIG. 10 prior to the fixing of the terminals into the housing mold.
Figure 12:
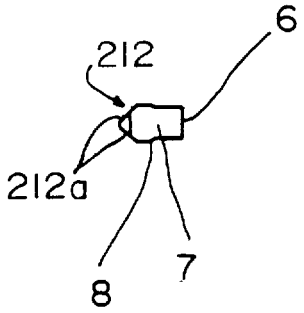
FIG. 12 shows the tip end of one of the terminals of FIGS. 10 & 11.

The terminals 2, 2' are preferably formed by a stamping and forming process, with the terminal body portions 208 being stamped from a metal carrier strip 220 (FIG. 10) and then formed to define the general U-shape at one end of the carrier strip as shown in FIG. 11.

It will be understood that although the preceding detailed description has utilized board to board connectors to demonstrate the features and advantages of the present invention, the present invention may also be suitable for use with, under certain conditions, edge card connectors and other connectors of small pitch where the terminals undergo some sort of insertion force during the connection process.

Figure 2A:
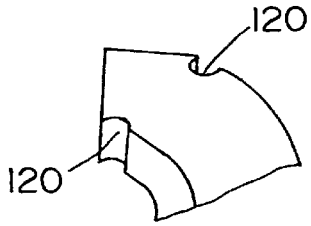
FIG. 2A is a fragmented perspective view of an alternate tip of the conductive terminal used in the connector of FIG. 1.

It shall also be noted that the first and second embodiments described above illustrate the terminal engagement ends having catches or projections on opposite sides thereof, but that such catches or projections may be formed on upper and lower surfaces of the terminal engagement end portions. In the alternative, recesses 120 (FIG. 2A) may be formed in place of such catches or projections. If such recesses are used rather than projections, upon insert molding the housing, the plastic material will fill such recesses in order to retain the tips of the terminals in place.

It will be appreciated that the embodiments of the present invention discussed herein are merely illustrative of a few applications of the principles of the invention. Numerous modifications may be made by those skilled in the art without departing from the true spirit and scope of the invention.

We claim:

1. In an electrical connector having an insert-molded housing and a plurality of terminals therein, said connector comprising:

an elongated insulative housing having opposed spaced apart sidewalls each providing a top edge and an outer side surface, a plurality of conductive terminals arranged along said housing, each of said terminals including an elongated terminal body which includes a contact portion, a solder tail portion and an end portion, the solder tail and end portions being disposed at opposite ends of said terminal body such that said contact portion lies therebetween, said end portion including a mold engagement portion for abutting against a portion of a mold during molding of said housing in order to accurately locate said end portion and a housing engagement portion adjacent said mold engagement portion, said mold engagement portion extends to the outer side surface of said sidewall of said housing, and said housing engagement portion and said housing having complementary interengaging means for embeddingly securing said housing engaging portion within said housing to thereby retain said terminal contact portion in place relative to said housing, said complementary interengaging means including a surface interruption along at least one surface of said terminal and a complementary shaped portion of said housing engaging said surface interruption.

2. The connector as defined in claim 1, wherein said surface interruption comprises at least one projection formed on said housing engagement portion extending outwardly therefrom.

3. The connector as defined in claim 2, wherein said projection extends from an edge of said terminals towards an adjacent terminal of said connector.

4. The connector as defined in claim 1, wherein said mold engagement portion includes a surface tapered away from a tip of said terminal.

5. The connector as defined in claim 4, wherein said mold engagement portion includes a pair of surfaces, each being tapered away from a tip of said terminal.

6. The connector as defined in claim 5, wherein end portion is arrowhead shaped.

7. The connector as defined in claim 1, wherein said terminal is generally U-shaped.

8. The connector as defined in claim 1, wherein said housing includes a pair of generally parallel sidewalls and a slot therebetween, a row of terminals being positioned along each said sidewall with said contact portions of said terminals lying substantially against interior wall surfaces of said respective sidewalls.

9. The connector as defined in claim 8, wherein each of said housing sidewalls have distinct upper surfaces and each of said terminal end portions is embedded in said sidewalls so as not to project substantially above said upper surfaces thereof.

10. The connector as defined in claim 8, wherein each said housing sidewalls has a distinct upper surfaces and said housing engagement portion includes at least one projection extending transverse to an axis of said terminal body, each of said projections being embedded in said sidewalls beneath said upper surfaces thereof.

11. The connector as defined in claim 8, wherein each said housing sidewall has an upper surface and said housing engagement portion is embedded in said housing sidewalls generally flush with said sidewall upper surfaces.

12. The connector as defined in claim 1, wherein said surface interruption comprises at least one recess formed on said housing engagement portion.

13. A method of manufacturing an electrical connector having a plurality of terminals arranged in a predetermined pitch along the length of the connector, said method comprising the steps of:

providing a plurality of terminals mounted to a carrier strip, each of the terminals having an elongated terminal body which includes a contact portion, a solder tail portion an end portion, the solder tail and end portions being disposed at opposite ends of said terminal body such that said contact portion lies therebetween, said end portion including a mold engagement portion for abutting against a portion of a mold during molding of said housing in order to accurately locate said end portion and a housing engagement portion adjacent said mold engagement portion, said housing engagement portion including a surface interruption along at least one surface of said terminal;

positioning said plurality of terminals within a mold having a cavity formed therein, said mold engagement portion abutting against a portion of a said mold in order to accurately locate said end portion;

injecting plastic within said mold about said terminals to form a connector assembly, said connector assembly including a complementary shaped portion of said housing engaging said surface interruption for embeddingly securing said housing engaging portion within said housing to thereby retain said terminal contact portion in place relative to said housing;

removing said connector assembly from said mold; and removing said carrier strip from said terminals.

14. An electrical connector comprising:

an elongated connector housing formed from an insulative material, the connector housing having an elongated slot disposed therein for receiving a complementary mating component, the slot having two opposing generally parallel sidewalls which substantially define a depth of said slot, each of the sidewalls having a generally planar inner surface associated therewith on opposite sides of said slot; and, a plurality of conductive terminals arranged in a row along each said sidewall, each said terminal including a solder tail portion at one end of said terminal extending away from said connector housing, a pair of generally parallel side edges, a contact portion between said terminal side edges and extending against one of said sidewall inner surfaces, and a tip retention portion at a second opposite end of said terminal and which extends at an angle from said contact portion and into said sidewall, the tip retention portion including at least one catch along one of said side edges which securely engages said sidewall and retains said terminal contact portion in place in said slot adjacent one of said sidewall inner surfaces, thereby preventing substantial movement of said terminal contact portions in response to forces exerted upon said contact portions when said complementary mating component is inserted into said slot.

15. The connector as defined in claim 14, wherein each said terminal tip retention portion includes a well-defined angled endtip.

16. The connector as defined in claim 14, wherein each said terminal tip retention portion includes an arrow-like endtip and two projections extending transversely away from a longitudinal axis of said terminal towards an adjacent terminal.

17. The connector as defined in claim 14, wherein said connector housing sidewalls include respective upper surfaces thereof and said terminal tip retention portions are embedded in said sidewalls at a level no greater than said upper surfaces.

18. The connector as defined in claim 14, wherein said connector housing two sidewalls include respective upper surfaces thereof and said terminal tip retention portions are embedded in said sidewalls at about the level of said upper surfaces.

19. The connector as defined in claim 14, wherein said terminal catches are received within a series of recesses formed along upper surfaces of said housing sidewalls.

20. The connector as defined in claim 19, wherein said housing sidewalls include a plurality of retention posts between adjacent recesses and said terminal catches engage said recesses to anchor said terminal contact portions in place adjacent said sidewall inner surfaces.

21. The connector as defined in claim 14, wherein said catch comprises at least one projection formed on said terminal tip retention portion extending outwardly therefrom.

22. The connector as defined in claim 21, wherein said projection extends from an edge of said terminals towards an adjacent terminal of said connector.

23. The connector as defined in claim 14, wherein said terminal tip retention portion includes a surface tapered away from a tip of said terminal.

24. The connector as defined in claim 23, wherein said terminal tip retention portion includes a pair of surfaces, each being tapered away from a tip of said terminal.

25. The connector as defined in claim 14, wherein said terminal is generally U-shaped.

26. The connector as defined in claim 14, wherein each said housing sidewall has an upper surface and each said terminal tip retention portion is embedded in one of said housing sidewall generally flush with said sidewall upper surface.

27. The connector as defined in claim 14, wherein said catch comprises at least one recess formed on said terminal tip retention portion.

28. The connector as defined in claim 14, wherein said terminal tip retention portion includes at least one projection formed on said terminal housing engagement portion extending outwardly therefrom in a direction generally parallel to said housing sidewalls.

29. The connector as defined in claim 14, wherein said connector housing is molded about said terminal tip retention portion.

* * * * *